US005265667A

United States Patent [19]

Lester, II et al.

[11] Patent Number: 5,265,667

[45] Date of Patent: Nov. 30, 1993

[54] ROBOTIC ARM FOR SERVICING NUCLEAR STEAM GENERATORS

[75] Inventors: Warren E. Lester, II, Pittsburgh; Daniel E. Klinvex, McKeesport, both of Pa.

[73] Assignee: Westinghouse Electric Corp., Pittsburgh, Pa.

[21] Appl. No.: 803,914

[22] Filed: Dec. 9, 1991

Related U.S. Application Data

[63] Continuation of Ser. No. 407,254, Sep. 14, 1989, abandoned.

[51] Int. Cl.[5] ..... B25J 19/00; B25J 5/00

[52] U.S. Cl. ..... 165/11.2; 165/76; 901/25; 901/49; 74/89.15

[58] Field of Search ..... 74/89.15; 165/11.2, 165/76; 414/744.5, 744.6; 901/25, 49

[56] References Cited

U.S. PATENT DOCUMENTS

| | | | |
|---|---|---|---|
| 4,137,784 | 2/1979 | Griffin | 74/89.15 |
| 4,174,999 | 11/1979 | Burns . | |
| 4,196,049 | 4/1980 | Burns et al. | 414/1 |
| 4,259,876 | 4/1981 | Belyanin et al. | 414/7 |
| 4,302,146 | 11/1981 | Finlayson et al. | 165/76 |
| 4,347,652 | 9/1982 | Cooper, Jr. et al. | 165/11.2 |
| 4,398,110 | 8/1983 | Flinchbaugh et al. | 414/4 |
| 4,435,116 | 3/1984 | Van Deberg | 74/89.15 |
| 4,438,805 | 3/1984 | Gugel | 165/76 |
| 4,514,616 | 4/1985 | Warner | 901/49 |
| 4,521,150 | 6/1985 | Pigeon et al. | 901/16 |
| 4,521,844 | 6/1985 | Sturges, Jr. et al. | 414/744.6 |
| 4,557,662 | 12/1985 | Terauchi et al. | 414/744 R |
| 4,577,127 | 3/1986 | Ferree et al. . | |
| 4,595,419 | 6/1986 | Patenaude | 901/44 |
| 4,624,042 | 11/1986 | Green | 29/723 |
| 4,648,784 | 3/1987 | Wiedemann et al. | 901/49 |
| 4,664,873 | 5/1987 | Hendrich et al. | 376/260 |
| 4,672,741 | 6/1987 | Zafred et al. | 29/726 |
| 4,673,027 | 6/1987 | Vermaat | 165/11.2 |
| 4,675,961 | 6/1987 | Spofford et al. | 29/33 K |
| 4,696,612 | 9/1987 | Germond et al. | 165/11.2 |
| 4,725,190 | 2/1988 | Kato | 901/49 |
| 4,729,423 | 3/1988 | Martin | 165/11.2 |
| 4,730,388 | 3/1988 | Nee et al. | 901/17 |
| 4,790,201 | 12/1988 | Sheddo | 74/89.15 |
| 4,804,038 | 2/1989 | Klahn et al. | 165/11.2 |
| 4,840,090 | 6/1989 | Iwata | 901/25 |
| 4,860,864 | 8/1989 | Cwycyshyn et al. | 901/49 |
| 4,945,979 | 8/1990 | Cullen et al. | 165/76 |
| 4,954,005 | 9/1990 | Knasel et al. | 901/49 |
| 5,002,173 | 5/1990 | Hucul et al. | 901/49 |

FOREIGN PATENT DOCUMENTS

| | | | |
|---|---|---|---|
| 0251039 | 11/1987 | German Democratic Rep. | 901/49 |

OTHER PUBLICATIONS

Sales Flyer entitled "Robotic Service Arm Model WL-2" by Westinghouse Electric Corporation, 1989.

*Primary Examiner*—John K. Ford

[57] ABSTRACT

An improved robotic arm which is capable of accurately manipulating a testing device beneath the tube sheet of the steam generator and accurately and consistently return to a selected tube location is provided. The robotic arm includes a base which is adapted to be fixedly secured to a support beam which initially positions the robotic arm within the steam generator, a first extension arm which is rotatably mounted on the base forming a primary rotation joint and which extends essentially parallel to the tube sheet. A second extension arm is rotatably mounted at the end of the first extension arm forming a secondary rotation joint and further extends therefrom. The testing device such as an eddy current inspection tool is positioned at a distal end of the second extension arm. The improvement includes a direct drive high-torque DC motor and a harmonic drive coupling being provided at each of the joints for providing a significant reduction ratio between the output of the high-torque DC motor and the rotational joint. Further, these components are of a light weight construction so as to limit the load carried by the robotic arm. A control device is provided for simultaneously independently controlling the high-torque DC motors such that the testing device can be both accurately and reliably positioned relative to the tube sheet. The robotic arm is also capable of being readily adjusted to be used in servicing various models of steam generators.

19 Claims, 5 Drawing Sheets

ROBOTIC ARM FOR SERVICING NUCLEAR STEAM GENERATORS

This application is a continuation of Ser. No. 07,407,254, filed Sep. 14, 1918, now abandoned.

BACKGROUND OF THE INVENTION

The present invention relates generally to the maintenance of steam generators of nuclear reactor power plants and, more particularly to a robotic arm for manipulating service devices relative to the tube sheet of a nuclear steam generator.

There are many situations in which a hazardous environment limits human access to various locations. One such situation occurs in the maintenance of operating steam generators of nuclear reactor power plants. A typical steam generator in a pressurized water nuclear reactor (PWR) includes a vertically oriented shell, a plurality of U-shaped tubes disposed in the shell so as to form a tube bundle, a tube sheet for supporting the ends of the tube bundle opposite its U-like curvature, and a dividing plate that cooperates with the tube sheet to form a primary fluid inlet plenum at one end of the tube bundle and a primary fluid outlet plenum at the other end of the tube bundle.

The steam generators of the PWR receive both primary and secondary fluids to produce steam for subsequent production of electricity in a conventional manner. The primary fluid, after being heated by circulation through the nuclear reactor core, enters the steam generator through the primary fluid inlet plenum. From its inlet plenum, the primary fluid flows upwardly through the one end of the tube bundle supported by the tube sheet, through its U-like curvature, downwardly through its opposite other end also supported by the tube sheet, and into its outlet plenum. At the same time, a secondary fluid, known as feedwater, is circulated around the U-shaped tube bundle in heat transfer relationship therewith, thereby transferring heat from the primary fluid in the tubes of the bundle to the secondary fluid surrounding the tube bundle and causing a portion of the secondary fluid to be converted to steam. Since the primary fluid contains radioactive particles and is isolate from the secondary fluid by the U-shaped walls of the tubes and by the tube sheet, it is important that the tubes and the tube sheet be maintained defect-free so that no leaks will occur in the tubes or in the welds between the tubes and the tube sheet thus preventing contamination of the secondary fluid by the primary fluid.

It is often necessary to repeatedly inspect the tubes of the bundle or tube sheet welds by way of access through the primary fluid inlet and outlet plena. For this purpose manways are provided in the vertical shell so that working personnel may enter the inlet and outlet plena to perform operations on the tubes and tube sheet. However, since the primary fluid, which is generally water, contains radioactive corrosion products, the inlet and outlet plena become radioactive which thereby limits the time that working personnel may be present therein. Accordingly, it would be advantageous to be able to perform operation on the tubes and tube sheet without requiring the entry of working personnel.

As is well known in the art, robotic systems can be used to reduce or eliminate manual operations in certain industrial operations. This reduction in manual operations may often result in significant productivity improvements in the operation. Moreover, in hazardous or limited access environments the use of robotic systems may not only be advantageous but may also be a necessity. For example, in the inspection of nuclear reactor power plants, it is important to be able to limit the time that working personnel are located in a radioactive environment so as to limit the working personnel's radiation exposure. Thus, the use of robotic systems in nuclear power plant maintenance can result in both improved productivity and in decreased radiation exposure.

In robotic arm systems, the elements which power the movements of the robotic arm may be located away from the arm joints (driving the joints by means of chains or belts) or the elements may be located at each joint. The use of actuators located at each joint decreases the compliance of the arm, but reduces the arm's load capability due to the added weight of the actuator on the arm. On the other hand, the use of actuators located remote from the joint reduces the weight of the arm, but increases compliance and decreases the accuracy of the arm's movement. It is therefore desirable that actuators located in the arms be both powerful and light weight. Traditionally, such actuators have been hydraulic-type actuators because no electric actuator could match the torque-to-weight ratios of hydraulic actuators. Hydraulic systems, however, are more difficult to control, are not capable of continuous rotation (vane type), and require a large amount of peripheral equipment (i.e., pumps and accumulators). Also, when used in environments where human access is limited, the possibility of contamination by the hydraulic fluid exists.

Presently, eddy current testing or inspection of the several tubes located within the tube sheet of a nuclear steam generator is carried out many number of times during the expected life of the steam generator. This service is presently carried out by a robotic arm, an example of which is the model SM-10W designed by Westinghouse Electric Corporation. This robotic arm is driven by a custom designed gearbox which over time experiences a great amount of back-lash due to the wear experienced in the gearbox and drive motor. Because accurate and reliable repeatability is required for carrying out the eddy current testing, that is the ability of the robotic arm to accurately and consistently return the testing mechanism to a particular tube location within the steam generator, the robotic arm must experience little wear and fluctuation in its movement over an extended period of time. Applicants have observed that the back-lash experienced in the present robotic arm has proven detrimental to the field performance of these arms. Over time, the present robotic arms lose their ability to accurately and consistently return to a particular tube location and operators have been forced to count the tubes during the eddy current inspection program in order to assure and verify their location Therefore, there is clearly a pressing need for a light weight high-torque drive mechanism which can be placed at both the primary and secondary joint locations, and which is capable of accurate operation over an extended period of time.

SUMMARY OF THE INVENTION

Generally speaking, the invention is an improved robotic arm which overcomes all of the aforementioned limitations associated with the robotic arms discussed above. The apparatus of the invention is an improved robotic arm which is capable of accurately manipulating an eddy current testing device or other service tool beneath the tube sheet of the steam generator and which can be accurately and consistently returned to a selected tube location. The robotic arm includes a base which is adapted to be fixedly secured to a support beam which initially positions the robotic arm within the steam generator, and a first extension arm which is rotatably mounted on the base forming a primary rotation joint and which extends essentially parallel to the tube sheet. A second extension arm is rotatably mounted at the end of the first extension arm forming a secondary rotation joint and further extends therefrom. A testing device such as an eddy current inspection tool is positioned at a distal end of the second extension arm. The improvement includes a direct drive high-torque DC motor and a harmonic drive coupling provided at each of the joints for providing a significant reduction ratio between the output of the high-torque DC motor and the rotational joint. Further, these components are of a light weight construction so as to limit the load carried by the robotic arm. Also, a control device is provided for simultaneously independently controlling the high-torque DC motors such that the testing device can be both accurately and reliably positioned relative to the tube sheet.

Additionally, positioning sensors or encoders are positioned at each of the joints for sensing and determining the rotational position of each of the extension arms relative to the other as well as the position of the testing device relative to the tube sheet. Further, in order to minimize wear which may be experienced as well as to guard against inadvertent damage to the arm, a spring biased clutch is provided for transferring the reduced rotational movement of the harmonic drive couple to the respective extension arm.

A further advantage of the present invention lies in its ability to be easily adjusted so as to perform servicing operations in the Westinghouse 44 and 51 Series nuclear steam generators as well as in the Combustion Engineering 67 and 3410 Series nuclear steam generators. This is carried out by adjusting the effective lengths of both the first extension arm and the second extension arm. The first extension arm includes a first section which is telescopically received within a second section thereof and includes a number of bores each of which correspond to a particular series of steam generator. The second section includes a bore for selectively registering with one of the bores of the first section. A locking pin is then inserted into the cooperating bore to lock the extension arm in the selected position. A second adjustment of the first extension arm may also be provided which is similar to the first and includes a third section which is telescopically received within another end of the second section and which includes a number of bores each corresponding to a particular series of steam generator. As with the first adjustment, the second section includes a bore and a second locking pin is inserted therein when the bores are in a proper predetermined alignment with one another. This locks the extension arm in the selected position. Similarly, the second extension arm includes an adjustment feature identical to the previously mentioned adjustment features which when combined, provide a robotic arm having an adjustable length sufficient to service the Westinghouse 44 and 51 Series steam generators, as well as the Combustion Engineering 67 and 3410 Series steam generators.

With the above mentioned direct drive high-torque DC motors and the particular harmonic drive, light weight, high-torque drive mechanisms are provided at each of the primary and secondary rotational joints. This provides high compliance and reliable movement of the robotic arm, as well as a robotic arm which has a higher payload capacity. Further, the average life expectancy of the robotic arm in accordance with the present invention is approximately 25,000 operation hours which represents significant savings in both operation and maintenance cost. Additionally, by utilizing such a robotic arm for servicing operations in nuclear steam generators, costly reactor vessel down time can be minimized, and radiation exposure of working personnel can be limited, and in most cases eliminated.

DETAILED DESCRIPTION OF THE PREFERRED EMBODIMENT

General Overview of the Preferred Embodiment

Figure 1:
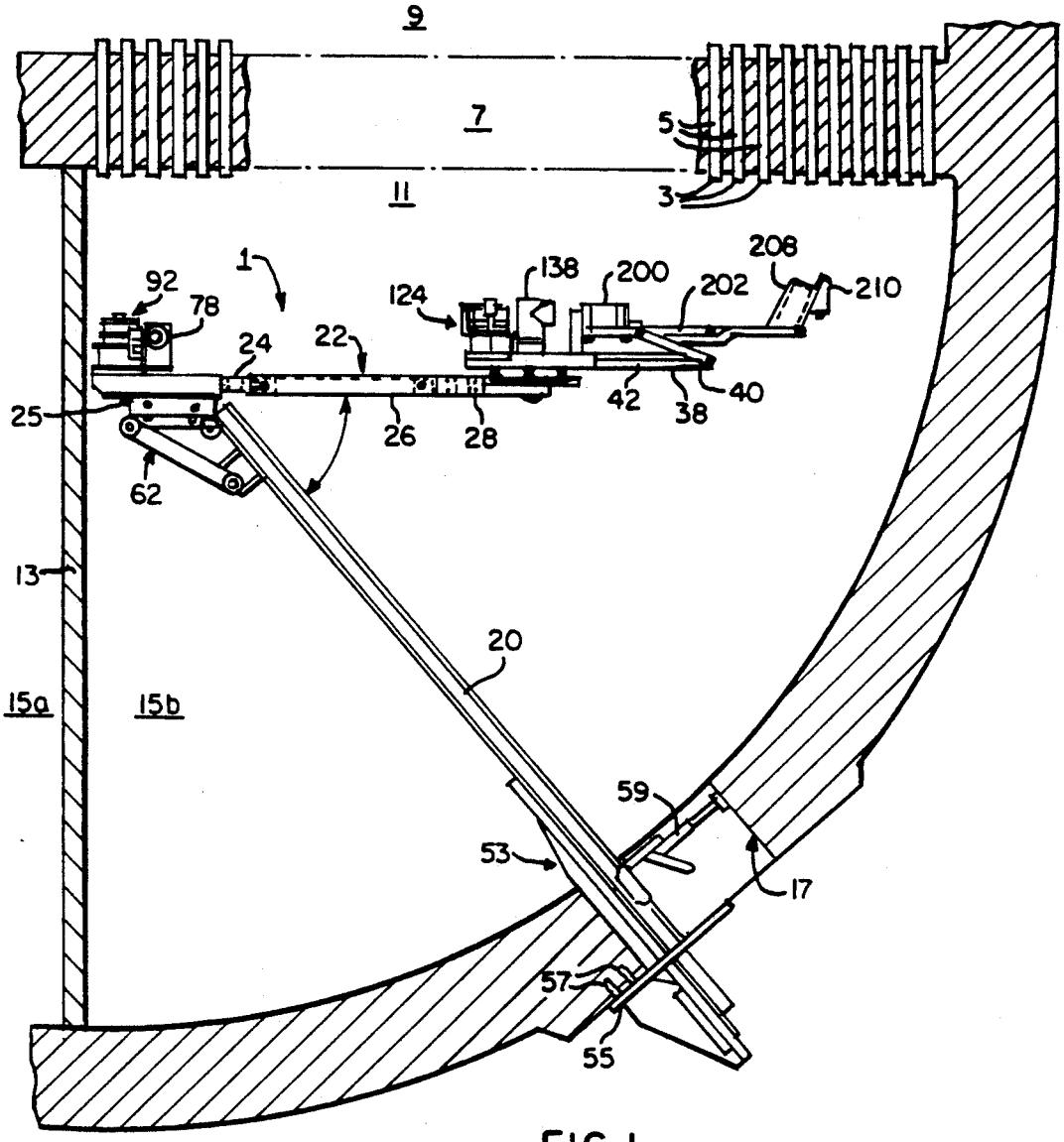
FIG. 1 is a side view of the robotic arm in accordance with the present invention as it would appear in operation within the channel head of a nuclear steam generator.

With reference now to FIG. 1, wherein like components are designated by like reference numerals throughout all of the several figures, the principal purpose of the robotic arm 1 of the invention is to deliver and position an eddy current inspection tool to the open ends 3 of selected heat exchanger tubes 5 of a nuclear steam generator, although the use of the arm 1 is not exclusively confined to such. The heat exchanger tubes 5 of such nuclear steam generators are mounted in a tube sheet 7 which hydraulically isolates a secondary side 9 of the generator (which contains nonradioactive water) from the bowl-shaped primary side 11 of the generator (which contains hot, radioactive water that has flowed through the nuclear core of the plant). The bowl-shaped primary side 11 is hydraulically bisected by means of a divider plate 13 which defines a pair of mutually adjacent channel heads 15*a*, 15*b*. Each of these channel heads 15*a*, 15*b* includes a man way 17 which allows the robotic arm 1 to be installed within the channel head as shown.

Figure 2:
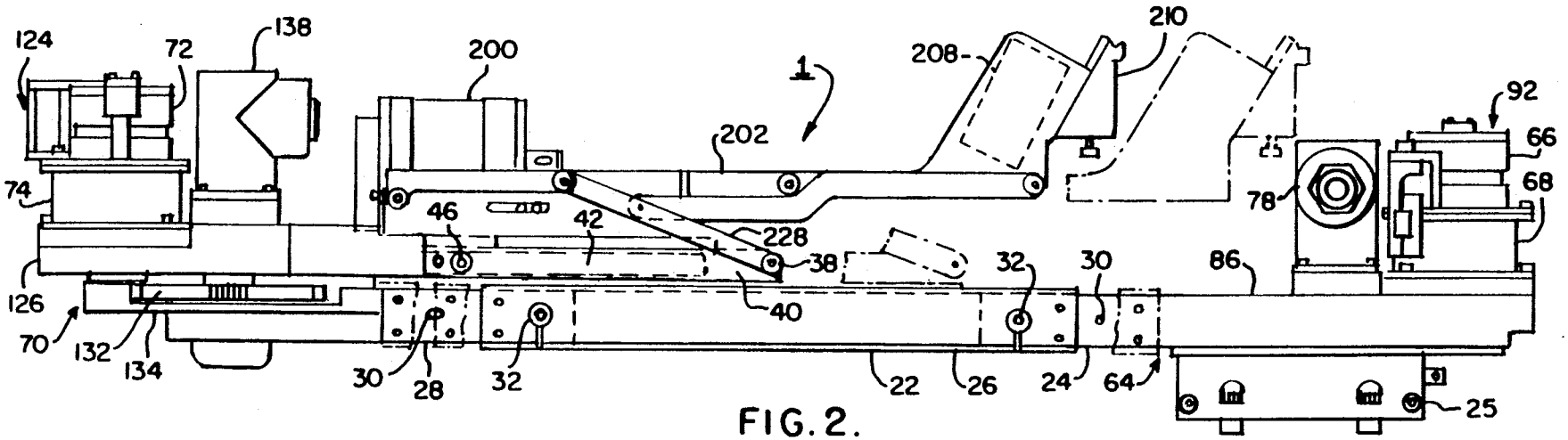
FIG. 2 is a side elevational view of the robotic arm in accordance with the present invention.

With reference now to FIGS. 1 and 2, the robotic arm 1 includes a support beam 20 mountable in the man way 17 of the steam generator for supporting an extension arm 22 in parallel relationship with the tube sheet 7.

The extension arm 22 includes a first section 24 that is rotatably connected to a base 25, and a second section 26 that telescopically receives the first section 24. The extension arm 22 includes a length adjustment assembly for varying the length of the extension arm 22 to fit a particular model of steam generator. A third section 28 is telescopically received within a distal end of the second section 26 in a similar manner as that of the first section 24.

The proximal end of the support beam 20 of the robotic arm 1 is mounted onto the periphery of the man way 17 by arm mounting assembly 53. Mounting assembly 53 includes a mounting plate 55 that is secured onto the bowl-shaped wall of the primary side 11 by means of bolts 57. The mounting assembly 53 further includes a jack 59 disposed between the beam 20 and an opposing wall of the man way 17 for applying a securing, compressive force to the proximal end of the beam 20. A pivotal connection assembly 62 connects the distal end of the beam 20 to the base 25 which rotatably supports the first section 24 of the extension arm 22. The pivotal movement afforded by the connection assembly 62 allows the robotic arm 1 to be inserted through the relatively narrow man way 17 in a "folded" position. Once the robotic arm 1 is completely within the channel head 15*b* and the proximal end of the support beam 20 secured onto the periphery of the man way 17 as described above, the pivotal connection assembly 62 allows the robotic arm 1 to be swung out and locked into a position which is substantially parallel with the underside of the tube sheet 7. To afford the requisite broad degree of movement to the testing device mounted at the distal end of the robotic arm 1, the extension arm 22 is connected to the distal end of the support beam 20 by means of a primary rotary joint 64. The principal components of the joint 64 which encompass the essence of the invention, are a direct drive high-torque DC motor 66 whose output is coupled to a harmonic drive 68 for imparting high-torque rotation to the extension arm while maintaining a high degree of reliability in its movement. A secondary rotary joint 70 having a second direct drive high-torque DC motor 72 and a second harmonic drive 74 rotatably connects the distal end of the third section 28 with the proximal end of the second extension arm 26. As will be discussed in more detail hereinafter, precise movement of the robotic arm 1 is accomplished by independently remotely controlling the DC motors 66 and 72 of the rotary joints 64 and 70 by way of a central control system (not shown) which affords both accurate and consistent positioning of the robotic arm 1.

Specific Description of the Preferred Embodiment

Figure 3:
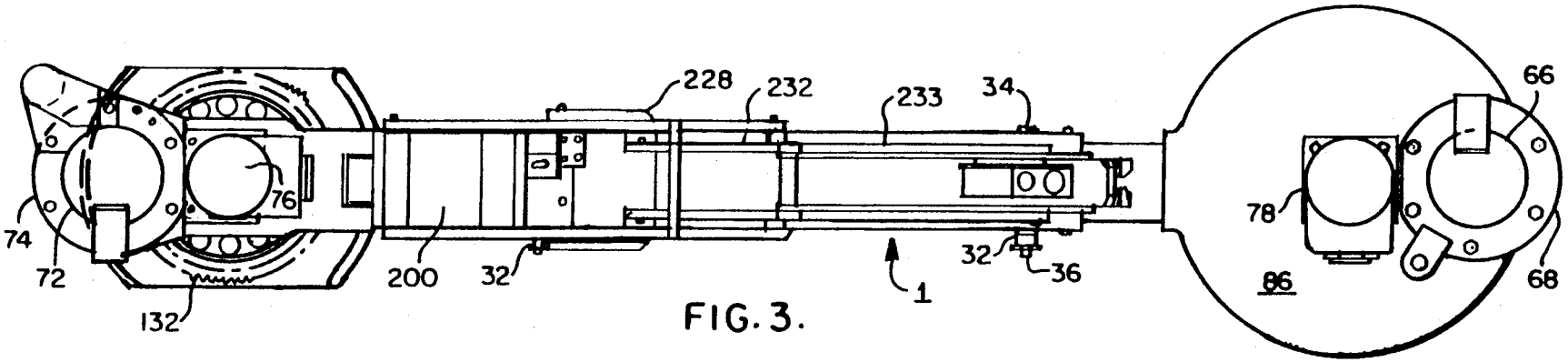
FIG. 3 is a top view of the robotic arm illustrated in FIG. 2.

With reference now to FIGS. 2 and 3, the length adjustment assembly will be discussed in greater detail. As stated previously the extension arm 22 is formed of a three piece construction including a first section 24 that is rotatably supported by the base 25, a second section 26 and a third section 28 with the second section 26 telescopically receiving each of the first and third sections. The first and third sections 24 and 28 each include a plurality of bores 30 extending therethrough while the second section 26 includes a bore (now shown) which when aligned with one of the bores 30 of each of the first and third sections, will be adapted to receive locking pins 32 which prevent the second section 26 from slidably moving axially with respect to either the first section 24 or the third section 28. As is best seen in FIG. 3, the locking pins 32 include a ball detent 34 at the distal end and a detent release 36 on their proximal end. The detent release 36 is capable of allowing the ball detent 34 to detract flush with the shaft of the pins 32 in a conventional manner in order to facilitate the insertion or removal of the locking pins 32. In the Preferred Embodiment, locking pins 32 are Model No. CL-4-BLT-B-3.0-S ball lock type pins available from Carlane Manufacturing Company, located in St. Louis, Mo.

A second extension arm 38 is similarly adjustable in its length by way of an outer section 40 which telescopically receives an inner section 42 which includes a plurality of bores 44 extending therethrough. These bores may best be seen in FIG. 6. Similar to the previously described adjustment assembly the outer section 40 includes a bore which when aligned with one of the bores 44 of the inner section 42, it is capable of receiving a locking pin 46 which prevents the outer section 40 from slidably moving axially with respect to the inner section 42. The locking pin 46 also includes a ball detent at its distal end and a detent release at its proximal end. In the Preferred Embodiment, locking pin 46 is a Model No. CL-3-BLP-B-2.5-S ball lock type pin available from Carlane Manufacturing Company. By providing the adjustment assemblies in both the first and second extension arms, the robotic arm 1 is capable of performing eddy current inspection operations in Westinghouse 44 and 51 Series steam generators as well as Combustion Engineering 67 and 3410 Series steam generators. These adjustment assemblies provide a robotic arm 1 which is capable of performing steam generator services in four different generators by performing a simple adjustment.

Figures 4, 5:
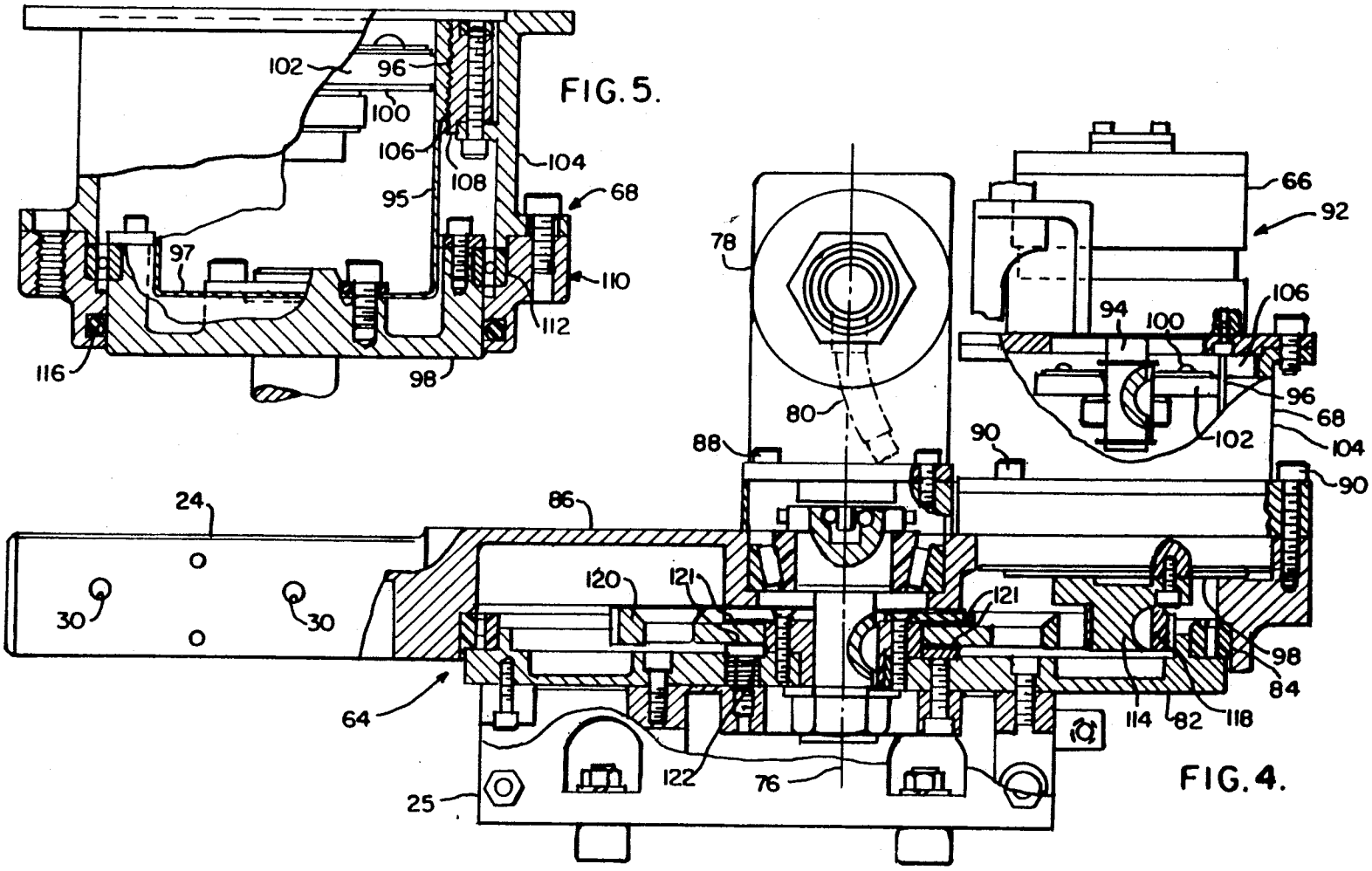
FIG. 4 is a partial cross-sectional elevational view of a primary rotational joint of the robotic arm in accordance with the present invention.
FIG. 5 is a partial cross-sectional view of the harmonic drive illustrated in FIG. 4 in accordance with the present invention.

Turning now to FIGS. 4 and 5, as stated previously, the base 25 is pivotally supported by the support beam 20 so as to be positioned essentially parallel to the tube sheet 7. The base 25 rotatably supports the extension arm 22 at the primary rotary joint 64. A central axis 76 of the primary rotary joint 64 provides a pivot point for the extension arm 22 and is provided with an encoder 78 for sensing and determining the rotational position of the extension arm 22. Information sensed by the encoder 78 is relayed to a central control system (not shown) by way of cable 80 wherein the operator of the robotic arm 1 will be appraised of the exact positioning of the extension arm 22 at all times. In the Preferred Embodiment, the encoder is a Model No. M25D-X-HSS8192G-XD8-X-S-C15-S-5 encoder, manufactured by BEI Motion Systems Company, Carlsbad, Calif.

As can be seen from FIG. 4, a support plate 82 is fixedly secured to the base 25 and includes bearings 84 for rotatably supporting a mounting plate 86 which is integrally formed with the first section 24 of the extension arm 22. The previously mentioned encoder 78 is fixed to the mounting plate 86 by way of screws 88, and eccentrically mounted on the mounting plate 86 by ways of screws 90 is a drive mechanism 92 which provides the driving force for pivoting the extension arm 22 about the primary rotary joint 64.

The drive mechanism 92 includes the direct drive high-torque DC motor 66 which is coupled to the harmonic drive 68. In the Preferred Embodiment the high-torque DC motor 66 is a Model No. SQT-02109-BO1 DC motor, manufactured by Inland Motor Company, Sierra Vista, Ariz., and the harmonic drive 68 is a modified Model No. PCR-5C-200-IGPSP harmonic drive, manufactured by Harmonic Drive, Wakefield, Mass. As can be seen from FIGS. 4 and 5, the harmonic drive 68 includes a cup shaped harmonic drive member 95 which includes a plurality of teeth 96 disposed about an upper periphery thereof. A bottom portion 97 of the cup shaped harmonic drive member 95 is secured to a lower housing portion 98 for transferring rotational movement to the lower housing 98. The harmonic drive mechanism 68 includes a drive member 100 which is of an elliptical configuration for generating a drive wave as the drive member 100 is rotated by the shaft 94 in response to rotation of the DC motor 66. A flexible ring 102 is positioned about the drive member 100. Fixedly secured to an upper housing 104 is a rigid outer ring 106 which includes a plurality of teeth 108 disposed about an inner circumference of the rigid outer ring 106 in a manner to mate with the teeth 96 of the harmonic drive member 95. The teeth 108 are greater in number than the teeth 96 so that the teeth 96 will mesh only at two radially opposed points about the circumference for providing a significant reduction in the rotational movement transferred to the extension arm 22. As can be seen from FIG. 4, the upper housing 104 is fixedly secured to the mounting plate 86, while the lower housing 98 is rotatably mounted adjacent a lower section 110 of the upper housing 104 by way of bearing 112. As can be seen from FIG. 5, rotational movement imparted to the harmonic drive member 95 is transferred to the lower housing 98 and consequently to a drive shaft 114. The inner portion of the harmonic drive 68 is grease packed, and seal 116 is provided between the lower portion 110 of upper housing 104 and the lower housing 98 so as to provide smooth relative rotation of the members.

A gear 118 is fixedly secured to the drive shaft 114 and is meshed with a disk gear 120 which is concentrically disposed about the central axis 76 of the primary rotary joint 64. The harmonic drive 68 is provided so as to communicate a rotational reduction between the DC motor 66 and the gear 118. With the harmonic drive of the Preferred Embodiment, this reduction ratio is approximately 200:1 which results in extremely accurate rotational positioning of the extension arm 22.

The plate gear 120 is fixed relative to the support plate 82 by way of clutch plates 121. As can be seen from FIG. 4, the clutch plates are spring biased into contact with the plate gear 120 by way of biasing member 122 so as to fix the rotary gear 120 relative to the support plate 82 during normal operation. However, if an obstruction is experienced during the rotation of the extension arm 22, the clutch plates 121 will allow the plate gear 120 to slip relative thereto to limit any damage which may occur to the robotic arm 1. By transferring rotational movement to the gear 118, the drive mechanism 92 will orbit about the plate gear 120 and consequently will rotate the mounting plate 86 and the extension arm 22 about the central axis 76 at a significantly reduced rate when compared the DC motor and at a high-torque. As mentioned previously, the rotational positioning of the extension arm 22 is constantly monitored by way of the encoder 78 which senses the rotational positioning of the extension arm 22.

Figure 6:
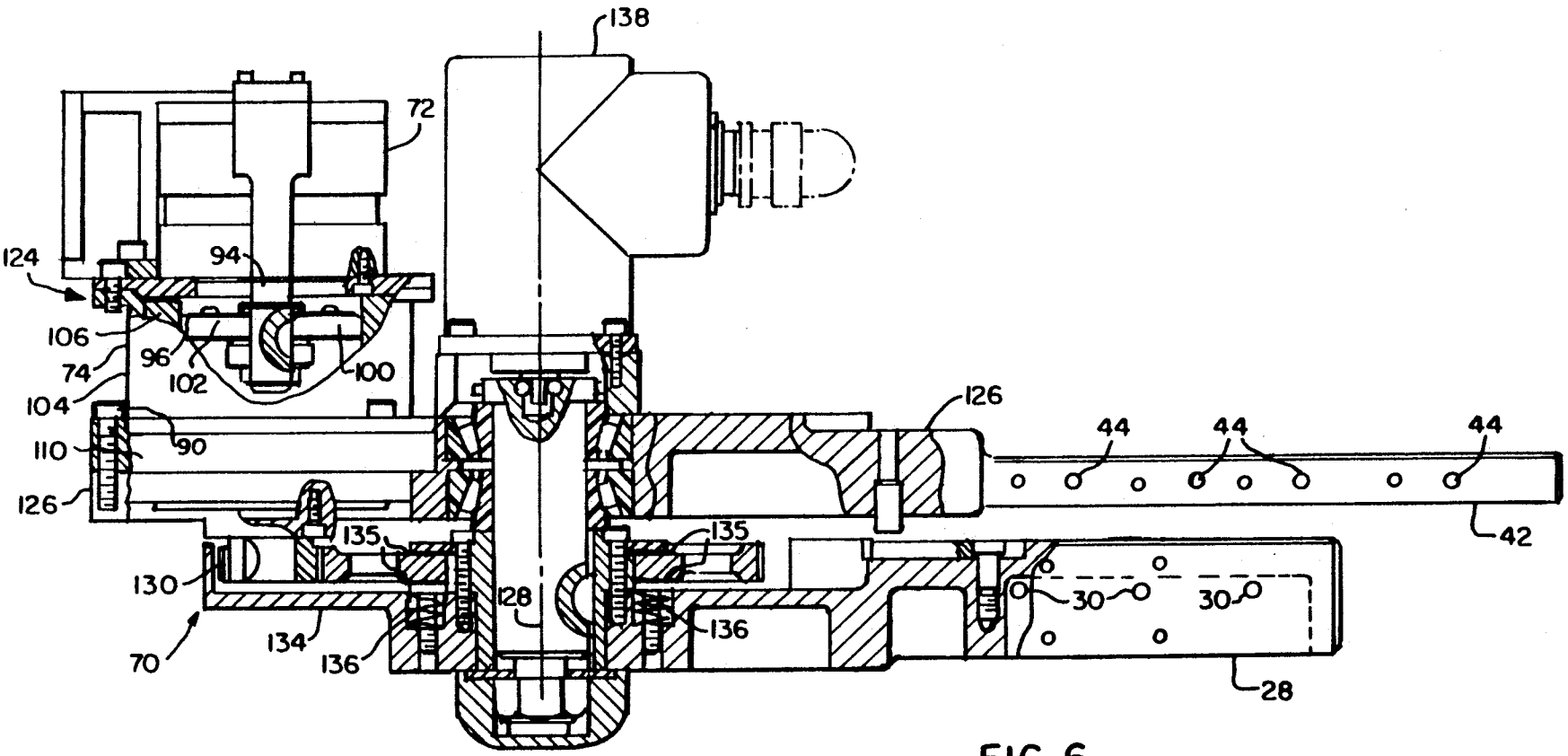
FIG. 6 is a partial cross-sectional elevational view of a secondary rotational joint in accordance with the present invention.

Turning now to FIG. 6, the secondary rotary joint for permitting rotational movement between the extension arm 22 and the extension arm 38 will be discussed in greater detail. The drive mechanism 124 is essentially identical to drive mechanism 92 and includes a direct drive high-torque DC motor 72 and a harmonic drive 74. As can be seen in FIG. 6, the harmonic drive 74 is fixedly secured to a support plate 126 for imparting rotational movement thereto about a central axis 128 of the second joint 70. The direct drive high-torque DC motor 72 is identical to DC motor 66 and in the Preferred Embodiment is a Model No. SQT-02109-BO1 DC motor, manufactured by Inland Motor Company, Sierra Vista, Ariz. The harmonic drive 74 is identical to harmonic drive 68 and is a modified Model No. PCR-5C-200-IGPSP harmonic drive manufactured by Harmonic Drive, Wakefield, Mass. As can be seen from FIG. 6 wherein like elements shown in FIGS. 4 and 5 will be referenced with like numerals, the harmonic drive 72 includes a cup shaped harmonic drive member 95 which includes a plurality of teeth 96 disposed about an upper periphery thereof. A bottom portion 97 of the cup shaped harmonic drive member 95 is secured to a lower housing portion 98 for transferring rotational movement to the lower housing 98. The harmonic drive mechanism 74 includes a drive member 100 which is of an elliptical configuration for generating a drive wave as the drive member 100 is rotated by the shaft 94 in response to rotation of the DC motor 72. A flexible ring 102 is positioned about the drive member 100. Fixedly secured to an upper housing 104 of the harmonic drive 74 is a rigid outer ring 106 which includes a plurality of teeth 108 disposed about an inner circumference of the rigid outer ring 106 in a manner to mate with the teeth 96 of the harmonic drive member 95. The teeth 108 are greater in number than the teeth 96 so that the teeth 96 will mesh only at two radially opposed points about the circumference for providing a significant reduction in the rotational movement transferred to the extension arm 22. As can be seen from FIG. 4, the upper housing 104 is fixedly secured to the support plate 126, while the lower housing 98 is rotatably mounted adjacent a lower section 110 of the upper housing 104 by way of bearing 112. Rotational movement imparted to the harmonic drive member 95 is transferred to the lower housing 98 and consequently to a drive shaft 114. Again, the inner portion of the harmonic drive 74 is similarly grease packed, and seal 116 is provided between the lower portion 110 of upper housing 104 and the lower housing 98.

A gear 130 is fixedly secured to the drive shaft 114 and is meshed with a disk gear 132 which is concentrically disposed about the central axis 128 of the secondary rotary joint 70. The harmonic drive 74 is provided so as to communicate a rotational reduction between the DC motor 72 and the gear 130. With the harmonic drive of the Preferred Embodiment, this reduction ratio is again approximately 200:1 which results in extremely accurate rotational positioning of the extension arm 38 relative to extension arm 22.

The plate gear 132 is fixed relative to a support plate 134 which is integrally formed with the third section 28 of the extension arm 22, by way of clutch plates 135. As can be seen from FIG. 6, the clutch plates 135 are spring biased into contact with the plate gear 132 by way of biasing member 136 so as to fix the rotary gear 132 relative to the support plate 134 during normal operation. However, as previously discussed with regard to extension arm 22, if an obstruction is experienced during the rotation of the extension arm 38, the clutch plates 135 will allow the plate gear 134 to slip relative thereto to limit any damage which may occur to the robotic arm 1. By transferring rotational movement to the gear 130, the drive mechanism 124 will orbit about the plate gear 134 and consequently will rotate the support plate 126 and the extension arm 38 about the central axis 128 at a significantly reduced rate when compared the DC motor and at a high-torque. As mentioned previously, the rotational positioning of the extension arm 38 relative to the extension arm 22 is constantly monitored by way of a second encoder 138 which senses the rotational positioning of the extension arm 38 relative to extension arm 22.

Each of the direct drive high-torque DC motors 66 and 72 are designed to have a peak torque of 150 IN-OZ and weighs approximately 40 ounces (2.5 lbs.). The harmonic drives 68 and 74 include 7000 series aluminum bodies and weigh approximately 3.5 lbs. such that the resultant overall weight of drive mechanisms 92 and 124 are 6.0 lbs. which can be easily supported by the robotic arm 1. In the Preferred Embodiment, the specific characteristics of the harmonic drive having a reduction ratio of 200:1 are as set forth below in Table I.

TABLE I

| RPM | Input Hp | Output Speed | Output Torque |
|---|---|---|---|
| 3500 | .16 | 17.5 | 410 |
| 1750 | .10 | 8.8 | 525 |
| 1150 | .06 | 5.8 | 600 |
| 500 | — | 2.5 | 800 |

Figure 8:
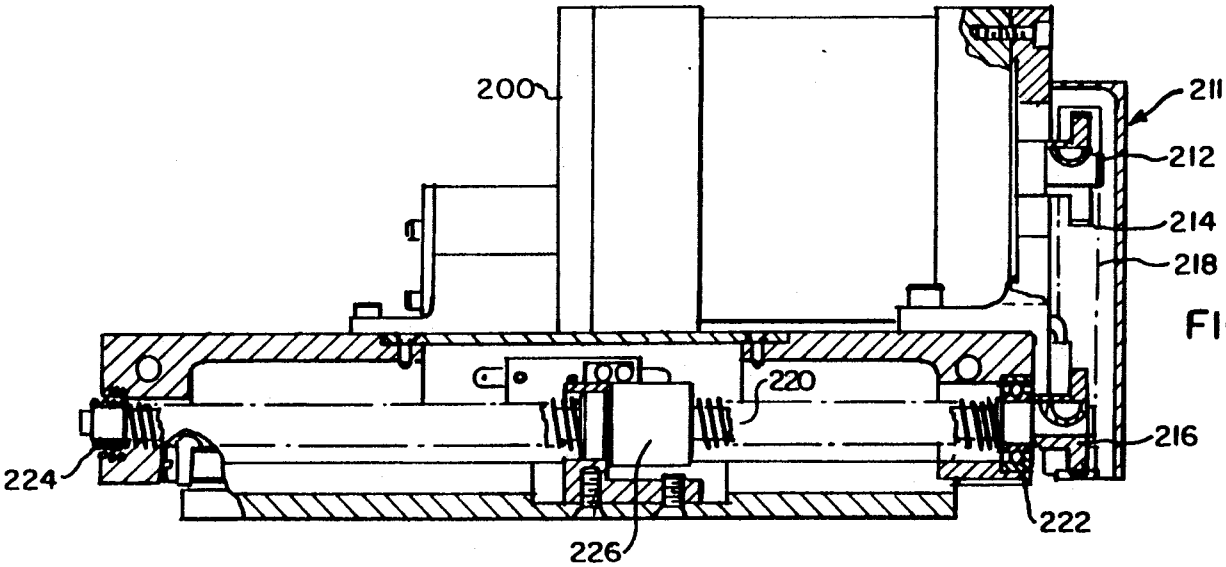
FIG. 8 is a partial cross-sectional elevational view of the drive mechanism for the lifting assembly in accordance with the present invention.
Figure 7:
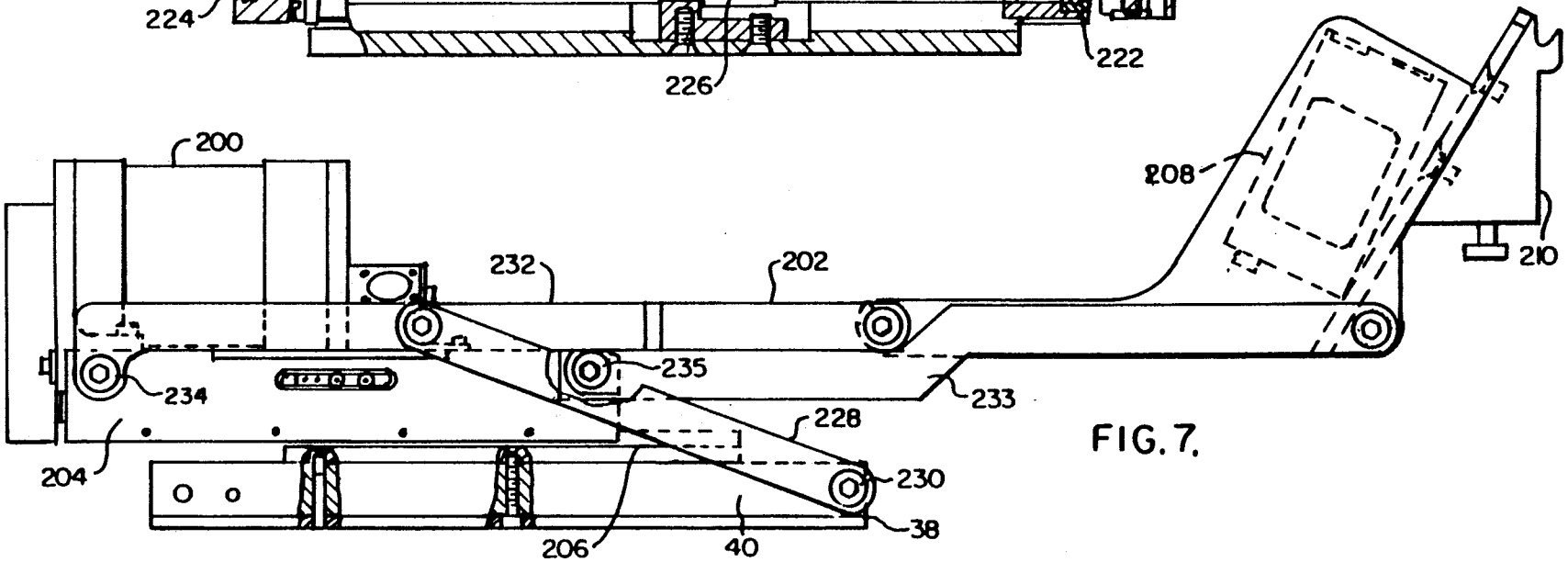
FIG. 7 is a side elevational view of the lifting assembly illustrated in FIG. 2.

Returning now to FIG. 2, it can be seen that the inner section 42 is integrally formed with the support plate 126 and extends into the outer section 40 forming the extension arm 38 which supports a lifting drive motor 200 and lifting linkage 202. This portion of the second extension arm 38 is shown in detail in FIG. 8. The outer section 40 of the second extension arm 38 slidingly supports a base 204 which slidingly reciprocates along a guide 206 in response to rotation of the lifting drive motor 200. Accommodated at a distal end of the lifting linkage 202 is an observation camera 208 and a mounting bracket 210 for accommodating the particular tool to be manipulated beneath the tube sheet 7 of the nuclear steam generator.

As can be seen from FIG. 9, the lifting drive motor 200 which is a Model No. SQT-02117-BO1 DC motor having a weight of approximately 75 ounces (4.7 lbs.) and a peak torque of 650 IN-OZ, includes a drive train 211 having a drive shaft 212 which drives a gear 214 which transfers rotational movement to the gear 216 by way of a chain or belt 218. Rotation of the gear 216 imparts rotational movement to a lead screw 220 which is rotationally received within the base 204 by way of bearings 222 and 224. A follower 226 is fixedly secured to the guide 206 wherein upon rotation of the lead screw 220 by way of the drive train 211, the base 204 is directed to move longitudinally with respect to the guide rail 206 and the extension arm 38 which pivots the arm 228 of the lifting linkage 202 about the pivot point 230. This in turn forces linkage arms 232 and 233 to pivot about the pivot points 234 and 235 respectively, which in turn forces the camera 208 and mounting bracket 210 in an upward direction. The specific amount in which the drive motor 200 is rotated in order to move the base 204 along guide rail 206 is directly controlled by the central control system (not shown) so as to properly position the particular servicing instrument in the preferred position beneath the tube sheet 7.

As can be seen from the foregoing, by providing a direct drive high-torque DC motor and the particular harmonic drive, light weight, high-torque drive mechanisms are evidenced at both the primary and secondary rotation joints of the robotic arm 1. In doing so, high compliance and reliability in movement are experienced and a robotic arm having a higher payload capacity is developed. Further, the expected average life of the robotic arm is five to ten times greater than that of the standard drive mechanisms presently in operation. By providing a robotic arm of the aforementioned type for servicing operations in nuclear steam generators, costly reactor vessel down time can be minimized, costly equipment repairs can be minimized, and radiation exposure of working personnel can be limited, and in most cases eliminated.

We claim:

1. A robotic positioning arm for accurately positioning a tool relative to a tube sheet in a nuclear steam generator comprising;

a base adapted to be fixedly secured to an initial positioning means;

a first extension arm rotatably mounted at a first end thereof on said base and extending therefrom;

a first drive means for rotating said first extension arm relative to said base including a first high-torque DC motor coupled with a first harmonic drive for reducing the rotation output of said first DC motor by a first predetermined reduction ration and effecting rotation of said first extension arm;

a second extension arm rotatably mounted at a first end thereof on a second end of said first extension arm and extending therefrom and having the tool mounted at a second end thereof;

a second drive means for rotating said second extension arm relative to said first extension arm including a second high-torque DC motor coupled with a second harmonic drive for reducing a rotational output of said second DC motor by a second predetermined reduction ratio and effecting rotation of said second extension arm;

a lifting linkage pivotally mounted on said second extension arm including a mounting bracket secured to a distal end of said linkage for supporting the tool, and a drive means for accurately moving said linkage including an electric motor, a follower connected to said linkage and a leadscrew connected to the output of the motor and threadedly engaged to said follower, and a control means for independently controlling said first and second drive means for accurately positioning the tool relative to the tube sheet in the nuclear steam generator, including first and second positioning sensors for determining a rotational position of said first and second joints, respectively, wherein both said first and second extension arms are disposed horizontally, and each of said joints includes a clutch means disposed between the output of the harmonic drive and its respective extension arm to minimize damage to the joint in the event that its respective arm should meet an obstruction during the operation of the drive means.

2. The robotic positioning arm as defined in claim 1, wherein said first predetermined reduction ratio is 200:1.

3. The robotic positioning arm as defined in claim 1, wherein said second predetermined reduction ratio is 200:1.

4. The robotic positioning arm as defined in claim 1, further comprising means for adjusting the length of said first and said second extension arm.

5. The robotic positioning arm as defined in claim 4, wherein said first extension arm includes a first and a second section with said first section being telescopically received within a first end of said second section, and said means for adjusting the length of said first extension arm includes a plurality of bores formed in said first section and at least one bore formed in said second section for selectively registering with one of said bores of said first section and a locking pin insertable into said registered bores for fixing said second section relative to said first section in a predetermined position.

6. The robotic positioning arm as defined in claim 5, wherein said first extension arm includes a third section telescopically received within a second end of said second section, said third section having a plurality of bores formed therein for selective registration with a second bore formed in said second section, and second locking pin insertable into said registered bores for fixing said second section relative to said third section in a predetermined position.

7. The robotic positioning arm as defined in claim 4, wherein said second extension arm includes a first and a second section with said first section being telescopically received within a first end of said second section, and said means for adjusting the length of said second extension arm includes a plurality of bores formed in said first section and at least one bore formed in said second section for selectively registering with one of said bores of said first section, and a locking pin insertable into said registered bores for fixing said second section relative to said first section in a predetermined position.

8. A robotic positioning arm for accurately positioning a tool relative to a tube sheet in a nuclear steam generator comprising;

a base adapted to be fixedly secured to an initial positioning means;

a first extension arm rotatably mounted at a first end thereof on said base and extending therefrom, said first extension arm including first and second telescopically interconnected sections;

a first drive means for rotating said first extension arm relative to said base including a first high-torque DC motor coupled with a first harmonic drive for reducing the rotation output of said first DC motor by a first predetermined reduction ratio and effecting rotation of said first extension arm;

a second extension arm rotatably mounted at a first end thereof on a second end of said first extension arm and extending therefrom and having the tool mounted at a second end thereof;

a second drive means for rotating said second extension arm relative to said first extension arm including a second high-torque DC motor coupled with a second harmonic drive for reducing a rotational output of said second DC motor by a second predetermined reduction ratio and effecting rotation of said second extension arm;

a length adjustment means for adjusting the length of said first and said second extension arms including a plurality of bores formed in said first section of said first extension arm and at least one bore formed in said second section of said first extension arm for selectively registering with one of said bores of said first section and a locking pin insertable into said registered bores for fixing said second section relative to said first section in a predetermined position; and a control means for independently controlling said first and second drive means for accurately positioning the tool relative to the tube sheet in the nuclear steam generator.

9. The robotic positioning arm as defined in claim 8, further comprising a first positioning sensor for sensing the rotational position of said first extension arm relative to said base.

10. The robotic positioning arm as defined in claim 9, further comprising a second positioning sensor for sensing the rotational position of said second extension arm relative to said first extension arm.

11. The robotic positioning arm as defined in claim 8, wherein said first predetermined reduction ratio is 200:1.

12. The robotic positioning arm as defined in claim 8, wherein said second predetermined reduction ratio is 200:1.

13. The robotic positioning arm as defined in claim 8, wherein said first extension arm includes a third section telescopically received within a second end of said second section, said third section having a plurality of bores formed therein for selective registration with a second bore formed in said second section, and second locking pin insertable into said registered bores for fixing said second section relative to said third section in a predetermined position.

14. The robotic positioning arm as defined in claim 8, wherein said second extension arm includes a first and a second section with said first section being telescopically received within a first end of said second section, and said means for adjusting the length of said second extension arm includes a plurality of bores formed in said first section and at least one bore formed in said second section for selectively registering with one of said bores of said first section, and a locking pin insertable into said registered bores for fixing said second section relative to said first section in a predetermined position.

15. The robotic positioning arm as defined in claim 8, further comprising a lifting linkage pivotally mounted on said second extension arm including a mounting bracket secured to a distal end of said linkage for supporting the tool, and a drive means for pivoting said lifting linkage for raising said mounting bracket and the tool to a predetermined position.

16. The robotic positioning arm as defined in claim 15, wherein said drive means includes a DC motor for rotating a lead screw in a forward and reverse direction, said DC motor and said lead screw being mounted on a reciprocable base supported by a guide means secured to said second extension arm and being reciprocable in a forward and rearward direction in response to the rotation of said lead screw.

17. The robotic positioning arm as defined in claim 16, further comprising a follower fixedly secured to said guide means for receiving said lead screw and causing said reciprocable base to reciprocate in said forward and rearward directions.

18. The robotic positioning arm as defined in claim 16, wherein rotation of said drive means is controlled by said control means.

19. A robotic positioning arm for accurately positioning a tool relative to a tube sheet in a nuclear steam generator comprising:

a base adapted to be fixedly secured to an initial positioning means;

a first extension arm rotatably mounted at a first end thereof on said base and extending therefrom;

a first drive means for rotating said first extension arm relative to said base including a first high-torque DC motor coupled with a first harmonic drive for reducing the rotation output of said first DC motor by a first predetermined reduction ratio and effecting rotation of said first extension arm;

a second extension arm rotatably mounted at a first end thereof on a second end of said first extension arm and extending therefrom and having the tool mounted at a second end thereof;

a second drive means for rotating said second extension arm relative to said first extension arm including a second high-torque DC motor coupled with a second harmonic drive for reducing a rotational output of said second DC motor by a second predetermined reduction ratio and effecting rotation of said second extension arm;

a lifting linkage pivotally mounted on said second extension arm including a mounting bracket secured to a distal end of said linkage for supporting the tool, and a drive means for accurately moving said linkage including an electric motor, a follower connected to said linkage and a leadscrew connected to the output of the motor and threadedly engaged to said follower;

adjustment means for adjusting the length of said first and said second extension arm;

a first positioning sensor for sensing the rotational position of said first extension arm relative to said base;

a second positioning sensor for sensing the rotational position of said second extension arm relative to said first extension arm; and a control means for independently controlling said first and second drive means for accurately positioning the tool relative to the tube sheet in the nuclear steam generator, wherein both said first and second extension arms are disposed horizontally during operation, and wherein each of said joints includes a clutch means disposed between the output of the harmonic drive and its respective extension arm to minimize damage to the joint in the event that its respective arm should meet an obstruction during the operation of the drive means.

* * * * *